United States Patent [19]

Trammell

[11] 3,938,314

[45] Feb. 17, 1976

[54] FALSE-TWIST TEXTURING PROCESS WITH HOLLOW FRICTION TWIST TUBES

[75] Inventor: George Roy Trammell, Martinsville, Va.

[73] Assignee: E. I. Du Pont de Nemours and Company, Wilmington, Del.

[22] Filed: May 10, 1974

[21] Appl. No.: 468,684

[52] U.S. Cl. ..... 57/157 TS; 57/34 HS; 57/77.4

[51] Int. Cl.[2] ..... D02G 1/02

[58] Field of Search .... 57/34 HS, 77.3, 77.4, 77.41, 57/157 TS

[56] References Cited

UNITED STATES PATENTS

| | | | |
|---|---|---|---|
| 3,066,473 | 12/1962 | Maeda | 57/77.4 |
| 3,537,250 | 11/1970 | Mackintosh | 57/77.4 |
| 3,643,412 | 2/1972 | Maeda et al. | 57/34 HS |
| 3,724,191 | 4/1973 | Hooper et al. | 57/34 HS |
| 3,724,196 | 4/1973 | Holland et al. | 57/77.4 |
| 3,826,075 | 7/1974 | Maruyama et al. | 57/157 TS |

FOREIGN PATENTS OR APPLICATIONS

| | | |
|---|---|---|
| 2,092,227 | 1/1972 | France |
| 2,245,468 | 4/1973 | Germany |

*Primary Examiner*—John Petrakes

[57] ABSTRACT

False-twist texturing processes which apply twist with hollow friction tubes, fitted at each end with a toroidal bushing, are improved by using a high friction bushing at the yarn inlet and a lower friction bushing at the yarn outlet. Further improvements are provided by adjustments in the yarn inlet and outlet angles, and the speeds of the bushing surfaces.

6 Claims, 3 Drawing Figures

FALSE-TWIST TEXTURING PROCESS WITH HOLLOW FRICTION TWIST TUBES

BACKGROUND OF THE INVENTION

This invention relates to a process for producing false-twist textured yarn, and is more particularly concerned with applying false-twist to yarn with hollow friction tubes.

False-twist texturing processes have used a variety of devices for applying false twist. The hollow friction tube, fitted with a toroidal bushing of high friction material on each end, is a particularly preferred type of false twister. One advantage of such a twister is its high rate of twist generation, due primarily to the fact that many turns of twist are inserted into the traveling yarn for each rotation of the tube. Such tubes are, moreover, relatively easily and inexpensively fabricated. Stringup of yarn through their relatively large axial openings is simple, and they are small enough to be readily positioned on existing yarnhandling equipment such as uptwisters, downtwisters, draw twisters, and the like. When increased torque is desired for obtaining a given degree of twisting, two (or more) hollow friction tubes may be used in series, as is known.

Hollow friction-twist tubes have been fitted at each end with identical toroidal bushings of deformable elastomeric material with high yarn-to-bushing friction and good resistance to wear. Generally the materials used for bushings comprise either hard rubber or synthetic elastomers (e.g., polyurethanes).

As higher and higher processing speeds are attempted, eventually a point is reached at which yarn instability occurs with the result that twist insertion becomes erratic and spaced twisted sections of yarn slip through the friction tube. The onset of instability can be moved to a greater yarn speed by increasing the yarn tension so as to keep the yarn more firmly in contact with the friction surfaces. This approach, however, quickly leads to tensile failure of the yarn being processed. Moreover, increase of yarn tension during false twisting undesirably increases the amount of shrinkage of the packaged yarn.

Chimura et al. disclose in German Patent No. 2,245,468, dated Apr. 5, 1973, that it is possible to produce a uniform and strong crimp even at a yarn running velocity of above 300 meters per minute, and to produce thereby a uniform crimped and bulked yarn, when the value of 1000 V/S is between 300-D and 500-D, and the ratio of $T_2/T_1$ is below 2, where:

- V is the yarn running velocity in m/min. on the frictional surface producing the twist,
- S is the peripheral velocity in m/min. in the middle of the frictional surface part cooperating with the yarn,
- D is the denier count of the yarn to be crimped,
- $T_1$ is the yarn tension in grams at the inlet side of the twist producing tube, and
- $T_2$ is the yarn tension in grams at the exit side of the twist producing tube.

The patent teaches that the process can be used with all thermoplastic synthetic yarns for which false twisting is possible. The process is illustrated with conventional polyester an polyamide feed yarns; the illustrations include ones where the operations of drawing and false-twist texturing are combined. The false-twist texturing equipment disclosed appears to be conventional except for the use of a cooling roll between the heater and the false-twist tube. Most of the illustrations use a tube fitted at each end with a toroidal bushing of a wear and tear resistant material with a high frictional value, polyurethane being the only material mentioned, and having an inner diameter of 35 mm. at the middle part of the surface cooperating with the yarn.

The present invention is an improvement over processes such as that of the above patent.

SUMMARY OF THE INVENTION

The invention provides a more favorable distribution of yarn tensions between the inlet and outlet bushings with a higher level of applied torque, resulting in more crimp or bulk in the false-twist textured product. The invention also provides a higher tension level upstream of the twister for any given tension level downstream from the twister. A higher level of torque application can be used without encountering twist slippage past the twister. The invention also provides for generally lower tensions downstream of the twister to reduce yarn shrinkage in the product without loss of bulk.

The improvements in the false-twist texturing process comprise feeding the yarn under a tension $T_1$ from the heater over a high friction toroidal surface located at an end of a friction-twist tube at an angle $\alpha$ of at least 85° to the yarn path, then passing the yarn over a low friction toroidal surface located at an end of a friction-twist tube at an angle $\beta$ of less than 80° to the yarn path and having a surface velocity no greater than that of the high friction surface, and withdrawing the yarn from the friction-twist tube under a tension $T_2$ where $T_2/T_1$, has a value of 1 to 2.

The angles $\alpha$ and $\beta$ are angles between the axis of revolution of the toroidal surfaces and the yarn path to or away from the surface, as measured around the outside of the toroidal surface. The angle $\alpha$ is preferably from 90° to 110°, and the angle $\beta$ is preferably from 50° to 80°. The toroidal surfaces are usually formed by gaskets inserted in opposite ends of a hollow friction-twist tube, but can be positioned in different tubes of a twisting device.

The second toroidal surface must provide a lower yarn-on-surface friction than the first surface. This can be accomplished by using gaskets of different materials which differ in surface friction, e.g., polyurethane and apiprene, of polyurethanes of different hardness. Preferably, a synthetic elastomer is used for the high friction surface and an extremely hard material, such as nickel-boron, is used for the low friction surface. Gaskets of the same shape and dimensions can be used. Preferably, the low friction surface has a lower surface velocity than the high friction surface, which further decreases the effective friction of the yarn. This can be accomplished by using toroidal surfaces which have different inner diameters, or by mounting the low friction gasket on a separate twisting tube which is rotated at a lower speed than the twister tube having the high friction surface.

It is quite surprising to find that decreasing the friction of the second surface, while keeping constant conditions at the high friction surface, increases the applied turns per inch of yarn twist and results in higher yarn crimp and bulk in the final product.

DETAILED DESCRIPTION

Figure 1:
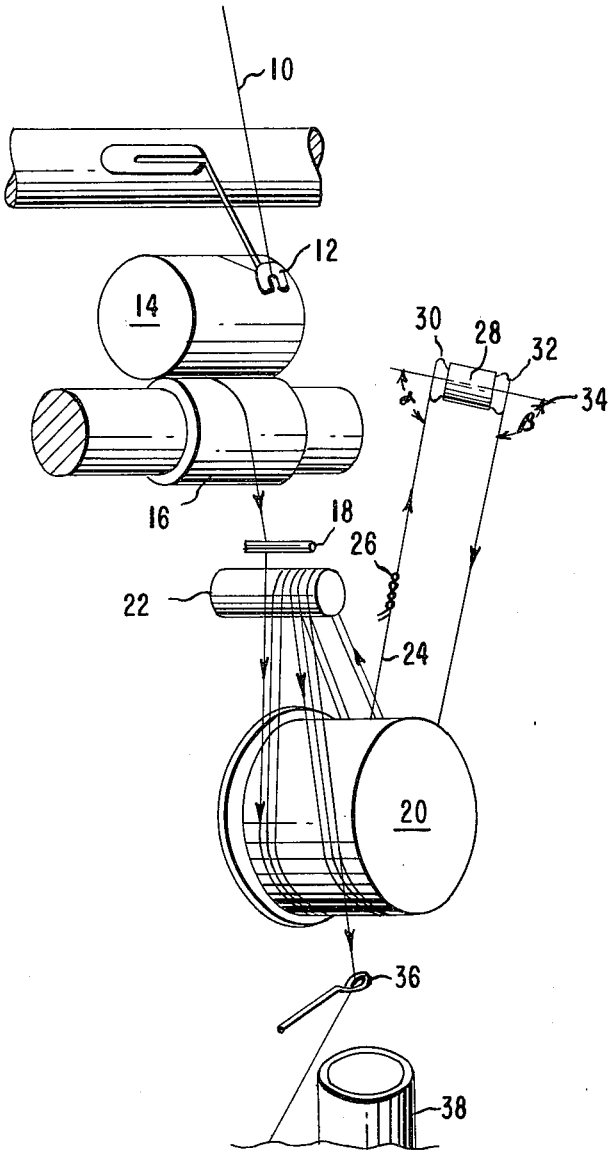
FIG. 1 is a schematic representation of one embodiment of the process and suitable apparatus for use in the process.

As shown in FIG. 1, undrawn yarn 10, from a suitable source, passes through guide 12 to cot roll 14, passes part way round the cot roll and then through the nip between the cot roll and driven feed roll 16. From the feed roll, the yarn passes around unheated draw pin 18 and takes several turns about draw roll 20 and its associated separator roll 22. The relative speeds of the feed roll and the draw roll are adjusted to provide the required draw ratio. Drawn yarn 24 departs from the draw roll tangentially through the nip with a spring-loaded nip roll (not shown) which prevents back-up of false twist around draw roll 20. Drawn yarn 24 then passes axially through the central opening of heater 26, which is a double helix of electrical resistance wire as described in Example I of U.S. Pat. No. 3,732,395. Yarn temperature at exit from heater 26 is about 185°C. The yarn heater utilized to provide the desired yarn temperature at this point may be of any type customarily employed for heat setting during false twisting. Yarn 24 is then twisted and untwisted in a false twist step, as is fully understood.

Figure 2:
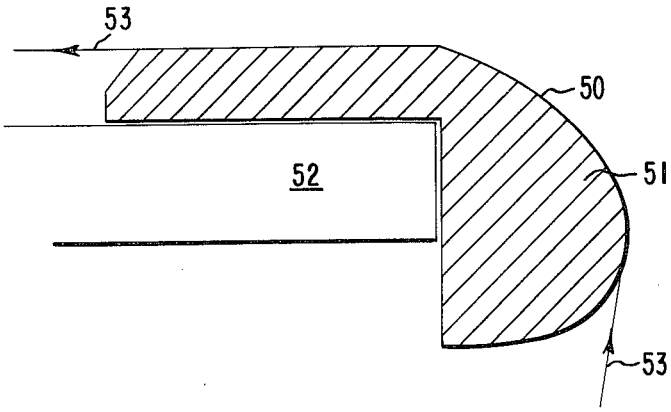
FIG. 2 is an enlarged cross-sectional view on a plane passing through the axis of the false twist rotor to show the configuration of the yarn-engaging bushing.

The false twist device employed is an electric motor 28 having a hollow rotor (not shown) to which is attached, at each of its 2 ends, a polyurethane bushing. FIG. 2 shows the cross-section of each bushing as obtained in a plane passing through the axis of rotation 34 of the rotor of motor 28. In FIG. 2, yarn progresses along directions 53 for an inlet bushing (reversed for outlet bushings) in contact with surface 50 of the bushing 51. Bushing 51 fits into the end of the hollow rotor 52 of the electric motor. As shown in FIG. 2, the inside of the hollow rotor is vertically above bushing 51 and extends to the left.

All the bushings used in the examples have identical sizes and shapes. They fit into the end of a hollow rotor having a 0.783 inch inside diameter to leave an opening through the torus-shaped bushing which is 0.625 inch in diameter. Overall length of each bushing (left to right in FIG. 2) is 0.58 inch, and outside maximum bushing diameter is 1.27 inches.

Referring again to FIG. 1, yarn 24 enters the twister around the lip of inlet bushing 30 and leaves around the lip of outlet bushing 32. The yarn path is characterized by inlet angle $\alpha$ and outlet angle $\beta$ with respect to the axis 34 of rotation of the bushings. Inlet angle $\alpha$ is preferably established solely by angular orientation or motor 28. Outlet angle $\beta$ may require the use of an additional yarn guide near bushing 32. From bushing 32, textured yarn 24 takes several wraps around draw roll 20 and separator roll 22 before passing via guide 36 to customary ring-and-traveler windup on pirn 38.

Figure 3:
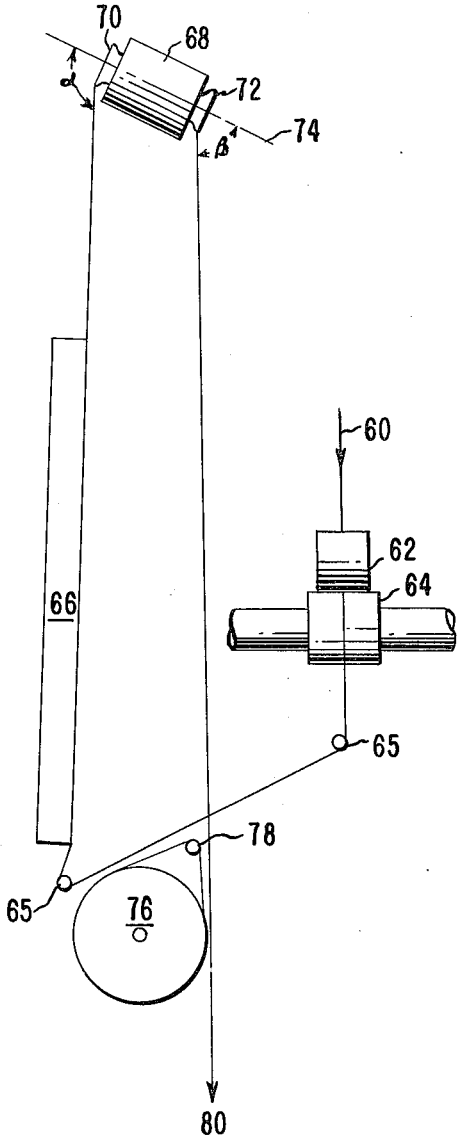
FIG. 3 is a schematic representation of another embodiment of the process and suitable apparatus for use in the process.

As shown in FIG. 3, undrawn yarn 60 from a suitable source is forwarded by passage through the nip between driven feed roll 64 and associated cot roll 62. Proceeding via guides 65, yarn 60 runs against hot plate 66 up to and through the hollow rotor (not shown) of electric motor 68. Inlet 70 and outlet 72 bushings of polyurethane are fastened to the ends of the hollow rotor. Yarn 60 contacts only the exposed surfaces of bushings 70 and 72 in passing through the rotor. Because the bushings rotate at high speed about axis 74, their frictional contact with running yarn 60 imparts a high level of false twist, as is well understood. Bushings 70 and 72 are geometrically identical to those discussed above. The twisted and untwisted yarn then passes to draw roll 76 and makes several turns around draw roll 76 and associated separator roll 78. The ratio of the peripheral velocity of draw roll 76 to that of feed roll 64 is the draw ratio, the actual drawing of the yarn occuring during the initial stage of heating on hotplate 66. Drawn and textured yarn 80 proceeds to windup as indicated in FIG. 1.

In the examples which follow, the following definitions and test methods apply.

Denier. This is the weight in grams of 9000 meters of yarn which is extended to remove the applied crimp. The weight of a much shorter length is actually measured and then converted to denier.

Crimp Index (CI) and Crimp Shrinkage (CS). A 750 denier skein of yarn is prepared by winding the requisite number of turns onto a reel to yield a skein which is about 55 cm. long when suspended freely with a weight attached at its bottom. The denier of the collapsed skein is, of course, twice that of the wound skein, i.e., 1500 denier. Initially at 500 gm. weight is suspended from the skein and, after 1 minute, its length $L_1$ is measured and recorded. The 500 gm. weight is then replaced with a 1.8 gm. weight, the skein is exposed to 100°C. steam at atmospheric pressure for 1 minute, it is dried in air for 10 minutes, and then its crimped length $L_2$ is measured and recorded. Finally, the 500 gm. weight is again attached and, after 1 minute, extended length $L_3$ is measured and recorded.

$$CI\% = 100 \times \frac{L_3 - L_2}{L_3}$$

$$CS\% = 100 \times \frac{L_1 - L_3}{L_1}$$

Turns per inch (TPI). This is a measure of the twist actually inserted by the hollow friction-twist tube. While the yarn is being processed, a sampling device very similar to a mousetrap is used to snatch a sample from the twist region immediately adjacent to the inlet bushing of the twister. The turns in a known length of the snatched sample are directly counted, the count being converted to turns per twisted inch.

Crimps per inch-restrained (CPIR). A length of textured yarn is removed from its package and taped to a black felt board without permitting any twist to occur. Two filaments are carefully separated out from the yarn so as to be parallel with about 0.75 inch separation. One pair of adjacent ends is fastened to a piece of adhesive tape cut to provide 7 mg./denier tension (weight in mg. is 14 times the denier per filament). The other pair of adjacent ends is also fastened to a piece of adhesive tape by which the assembly is suspended. Saturated steam is played onto the assembly for 1 minute and then the parallel filaments are taped to a glass microscope slide while still suspended in air. After the ends are cut off, a half inch length of one filament is projected optically onto a projection screen from which the number of crimps developed is counted. This count, multiplied by 2, is CPIR.

EXAMPLE I

This example uses process and apparatus embodiments disclosed in FIG. 1, and described previously, to treat undrawn, three-filament, polyhexamethylene adipamide yarn. After drawing the yarn is 18 denier.

Several yarns are produced, using the process conditions shown in Tables I and II. Inlet bushings G are always identical, having a high yarn-to-bushing friction. Outlet bushings A are of lower yarn-on-bushing friction than the inlet bushings, and outlet bushings G, which are identical to the inlet bushings, are used in comparison tests. Varying outlet angles ($\beta$) are also employed. The peripheral speed of the draw roll is 700 yards per minute to provide a draw ratio of 4.100 (ratio of drawn to undrawn length) in each test.

As an indication of relative yarn-on-bushihing friction levels for the "G" and "A" bushings, tension measurements are made on yarns being processed as shown in FIG. 1 and described above except that two hollow-rotor electric motors are used. The first motor has only an exit bushing about which the yarn changes direction by 80° while in contact. The second motor has only an inlet bushing about which the yarn makes a further change in direction of 50° while in contact. A distance of 3 inches separates the two bushings. Both electric motors rotate at 16,200 rpm. Tension ($T_1$) on the yarn just prior to contacting the bushing of the first motor and tension ($T_2$) on the yarn just after contacting the bushing of the second motor are measured. When both bushings are G bushings, $T_1 = 4.0$ gm., $T_2 = 23.5$ gm., and $T_2/T_1 = 5.88$. When both bushings are A bushings, $T_1 = 6.5$ gm., $T_2 = 22$ gm., and $T_2/T_1 = 3.38$. While the precise equation for computing friction coefficient from this arrangement of parts is not known, it is well known that friction coefficient ($f$) is approximately proportional to the logarithm of $T_2/T_1$. Thus, $$f_G/f_A \cong \frac{\log 5.88}{\log 3.38} = 1.45$$

clearly showing a significantly lower friction coefficient for the A bushings.

Table I present the process variations used for the tests. Table II presents the twist and tension results obtained.

TABLE I

| | PROCESS VARIATIONS | | | | |
|---|---|---|---|---|---|
| | Bushing | | Motor Speed | Angles (degrees) | |
| Test | In | Out | RPM | $\alpha$ | $\beta$ |
| 1A | G | G | 20,000 | 85 | 50 |
| 1B | G | A | 20,000 | 85 | 50 |
| 1C | G | A | 20,000 | 85 | 85 |
| 1D | G | A | 24,000 | 85 | 50 |
| 1E | G | A | 24,000 | 85 | 50 |
| 1F | G | A | 24,000 | 85 | 80 |
| 1G | G | G | 24,000 | 85 | 80 |

TABLE II

| | TWIST AND TENSION RESULTS | | | |
|---|---|---|---|---|
| | | Tension (gm.) | | Outlet/Inlet |
| Test | TPI | In | Out | Tension Ratio |
| 1A | 131 | 7 | 17.2 | 2.46 |
| 1B | 148 | 9 | 16 | 1.78 |
| 1C | 162 | 8½ | 18½ | 2.18 |
| 1D | 158 | 8 | 16 | 2.00 |
| 1E | 167 | 10 | 17 | 1.70 |

TABLE II-continued

| | TWIST AND TENSION RESULTS | | | |
|---|---|---|---|---|
| | | Tension (gm.) | | Outlet/Inlet |
| Test | TPI | In | Out | Tension Ratio |
| 1F | 171 | 10 | 14½ | 1.45 |
| 1G | 171 | 7 | 18½ | 2.64 |

Test 1A is a comparison test using identical inlet and outlet bushings. Test 1B is like Test 1A in every respect except that the lower friction A bushing is used at the outlet. Higher applied twist (TPI) and lower tension ratio result. Test 1C duplicates Test 1B except that outlet angle $\beta$ is increased from 50° to 85°. Applied twist increases further, but at an increased tension ratio. Tests 1D through 1G generally repeat tests 1A to 1C, but at a higher twist-motor speed. Comparing 1D with 1B, more twist is inserted at about the same tension ratio. Test 1F repeats Test 1D except for increasing outlet angle $\beta$. Slightly increased twist results, but the tension ratio is surprisingly reduced. Test 1G is like Test 1F except for use of identical inlet and outlet bushings, which is seen to dramatically increase the tension ratio.

The above data demonstrate that the use of lower-friction outlet bushings results in the insertion of more twist and a reduction of the ratio of outlet to inlet yarn tensions. Proper selection of outlet angle $\beta$ is also important, but does not change the above conclusions.

EXAMPLE II

This example uses process and apparatus embodiments disclosed in FIG. 3, and described previously, to treat undrawn feed yarn.

Spun polyhexamethylene adipamide yarn with seven filaments and a total denier of 53 is drawn and false twisted as described. Yarn speed on draw roll 76 is 850 yd./min. to provide a draw ratio of 2.619. Hot plate 66 is 20 inches long and heated to 230°C. surface temperature. Yarn 60 contacts hot plate 66 only along 10 inches of its length. Inlet yarn angle $\alpha$ is 90°, and outlet angle $\beta$ is 69°. Rotational velocity of bushings 70 and 72 is 30,000 rpm. Windup of drawn and textured yarn 80 is at a yarn speed 5.3% less than the draw-roll velocity. Bushing friction is indirectly measured in terms of hardness in degrees of International Rubber Hardness using a Shore Type A Durometer (ASTM Test No. D1415-56T). The harder the bushing, the lower is the yarn-to-bushing friction.

In test 2A, the inlet bushing has a Shore A hardness of 80° and the outlet bushing a Shore A hardness of 97°. In comparison test 2B, both bushings have a Shore A hardness of 80°. Yarn tension $T_1$ immediately prior to reaching bushing 70 and yarn tension $T_2$ immediately after leaving bushing 72 are measured (Any customary yarn tensiometer suffices. A Rothschild electronic tensiometer is employed). Critical processing parameters are given in Table III, and yarn properties obtained are shown in Table IV. It is seen that use of a lower friction outlet bushing (Test 2A), as compared to use of identical inlet and outlet bushings (Test 2B) results in lower crimp shrinkage (CS), increased stretch (CI), lower $T_2/T_1$ ratio, and a higher level of input tension $T_1$.

EXAMPLE III

This example duplicates Example II in all respects except for increasing inlet angle $\alpha$ to 100°. Test 3A uses bushings identical to those of Test 2A; and Test 3B is a comparison test using bushings identical to those of Test 2B. As in Example II, critical process and product properties are shown in Tables III and IV. Again it is seen that the use of lower friction outlet bushings provides lower crimp shrinkage (CS), increased stretch (CI), lower $T_2/T_1$ ratio, and a higher level of input tension $T_1$. It is seen further that use of an inlet angle $\alpha$ exceeding 90° results in still further improvements of the same kind.

EXAMPLE IV

Example III is repeated identically in every respect except for reducing outlet angle $\beta$ from 69° to 62°. Comparison of Test 4B with comparison Test 4A confirms the previous improvements resulting when the outlet bushing is of lower friction than the inlet bushing. Comparison of Test 4A with Test 3A, or Test 4B with Test 3B, shows that reduction of outlet angle $\beta$ affects results very little. There is, however, a slight desirable shift of outlet tension $T_2$ to the inlet side ($T_1$). Crimp shrinkage (CS), on the other hand, is significantly increased.

EXAMPLE V

The process as shown in FIG. 3 and generally as described in Example II is employed to produce four-filament false-twist textured yarns of polyhexamethylene adipamide. The undrawn feed yarn is one designed to provide a nominal total denier of 18 when drawn. The draw ratio employed is 3.878 at a draw roll peripheral speed of 870 yd./min. The yarn contacts the full 20-inch length of the hot plate, which has a surface temperature of 189°C. The twister bushings rotate at 33,000 rpm. Inlet angle $\alpha$ is 90°, and outlet angle $\beta$ is 69°. In Test 5A, the inlet bushing is of polyurethane having a Shore A hardness of 80°. The outlet bushing, however, is a geometrically identical bushing of acrylonitrile-butadiene-styrene) (ABS) polymer coated with a smooth uniform layer of nickel-boron to a thickness of about 0.001 inch. This coating is applied by tumbling the preformed ABS bushing in an electroless plating bath at a pH of about 6.4 and a temperature of 55°C. The electroless plating bath is composed of: 50 gm./l. of nickel acetate, 25 gm./l. of dihydrated sodium citrate, 25 gm./l. of lactic acid, 2.5 gm./l. of dimethylamine borane, 0.1 gm./l. of thiodiglycolic acid, and 0.1 gm./l. of a commercial wetting agent. The smooth coated bushing is too hard to obtain a meaningful reading using the Shore Type A Durometer (i.e., it reads 100°). In comparison Test 5B, both bushings are identical polyurethane bushings having a Shore A hardness of 80°. Again it is shown that a lower friction outlet bushing decreases crimp shrinkage (CS), increases stretch obtained (CI), and very favorably decreases the outlet-to-inlet tension ratio while simultaneously increasing the level of inlet tension.

TABLE III

| | PROCESS VARIATIONS | | | | | | |
|---|---|---|---|---|---|---|---|
| | Bushing Hardness Shore A (degrees) | | Angles (degrees) | | Tension (gm.) | | Outlet/Inlet Tension |
| Test | In | Out | $\alpha$ | $\beta$ | In | Out | Ratio |
| 2A | 80 | 97 | 90 | 69 | 11.8 | 16.0 | 1.36 |
| 2B | 80 | 80 | 90 | 69 | 8.0 | 17.8 | 2.22 |
| 3A | 80 | 97 | 100 | 69 | 11.5 | 15.4 | 1.34 |
| 3B | 80 | 80 | 100 | 69 | 8.5 | 18.0 | 2.12 |
| 4A | 80 | 97 | 100 | 62 | 11.8 | 15.3 | 1.30 |
| 4B | 80 | 80 | 100 | 62 | 9.5 | 16.8 | 1.77 |

TABLE III-continued

| | PROCESS VARIATIONS | | | | | | |
|---|---|---|---|---|---|---|---|
| | Bushing Hardness Shore A (degrees) | | Angles (degrees) | | Tension (gm.) | | Outlet/Inlet Tension |
| Test | In | Out | $\alpha$ | $\beta$ | In | Out | Ratio |
| 5A | 80 | >100 | 90 | 69 | 10.7 | 10.8 | 1.01 |
| 5B | 80 | 80 | 90 | 69 | 8.6 | 13.6 | 1.58 |

TABLE IV

| | YARN PROPERTIES | | | |
|---|---|---|---|---|
| Test | Denier | Elongation (%) | CI (%) | CS (%) |
| 2A | 21.3 | 32 | 54.1 | 6.3 |
| 2B | 21.4 | 36 | 49.5 | 7.1 |
| 3A | 21.4 | 36 | 56.7 | 6.0 |
| 3B | 21.3 | 38 | 54.9 | 6.7 |
| 4A | 21.5 | 38 | 55.7 | 6.9 |
| 4B | 21.6 | 37 | 55.3 | 7.5 |
| 5A | 17.8 | 22 | 67.1 | 3.1 |
| 5B | 17.7 | 22 | 66.6 | 3.6 |

EXAMPLE VI

This example shows the effect of operating the inlet and outlet bushings at different peripheral twisting velocities. Processing is as described in Example I, but using two hollow-rotor motors each with one bushing as described for determination of relative friction coefficients of the two types of bushings. In this example, both bushings are of the G variety. Inlet angle $\alpha$ is 85° and outlet angle $\beta$ is 50°. Peripheral velocity of the draw roll is 700 yd./min. Results are:

| | Motor Speed (RPM/1000) | | Tension (gm.) | | Tension Ratio | | |
|---|---|---|---|---|---|---|---|
| Test | In | Out | In | Out | ($T_2/T_1$) | TPI | CPIR |
| 6A | 20 | 20 | 6 | 17 | 2.8 | 154 | 18 |
| 6B | 22 | 20 | 7 | 20 | 2.8 | 158 | 21 |
| 6C | 24 | 20 | 8 | 18 | 2.2 | 167 | 22 |

It is apparent that, as the peripheral velocity of the outlet bushing becomes progressively less than that of the inlet bushing, more tension is transferred to the inlet bushing. Both applied twist (TPI) and crimp level developed (CPIR) increase correspondingly.

In a comparable process utilizing a single twist tube with a bushing on each end, the same results are obtained if the outlet bushing has a smaller effective diameter for its yarn-contact surfaces.

I claim:

1. In the false-twist texturing process wherein synthetic thermoplastic yarn is passed continuously through a heating zone and through one or more hollow friction-twist tubes fitted with toroidal bushings to heat-set latent crimp in the yarn; the improvements which comprise feeding the yarn under a tension $T_1$ from the heating zone over a high friction toroidal surface of a synthetic elastomer located at an end of a friction-twist tube at an angle $\alpha$ of at least 85° to the yarn path, then passing the yarn over a low friction toroidal surface of an extremely hard material located at an end of a friction-twist tube at an angle $\beta$ of 50° to 80° to the yarn path and having a surface velocity no greater than that of the high friction surface, and withdrawing the yarn from the friction-twist tube under a tension $T_2$ where $T_2/T_1$ has a value of 1 to 2.

2. The process defined in claim 1 wherein the angle $\alpha$ is from 90° to 110°.

3. The process defined in claim 1 wherein the toroidal surfaces are formed by gaskets inserted in opposite ends of a hollow friction-twist tube.

4. The process defined in claim 1 wherein the toroidal surfaces are formed by gaskets positioned in different friction-twist tubes.

5. The process defined in claim 1 wherein the toroidal surfaces are formed by gaskets of different materials which differ in surface friction.

6. The process defined in claim 1 wherein the low friction surface has a lower surface velocity than the high friction surface.

* * * * *